US008957656B2

(12) United States Patent
Yang et al.

(10) Patent No.: US 8,957,656 B2
(45) Date of Patent: Feb. 17, 2015

(54) POWER CONTROLLER AND CONTROL METHOD FOR GENERATING ADAPTIVE DEAD-TIMES

(75) Inventors: Fong-Cheng Yang, Hsin-Chu (TW); Kuo-Chien Huang, Hsin-Chu (TW)

(73) Assignee: Leadtrend Technology Corp., Science-Based Industrial Park, Hsin-Chu (TW)

( * ) Notice: Subject to any disclaimer, the term of this patent is extended or adjusted under 35 U.S.C. 154(b) by 155 days.

(21) Appl. No.: 13/605,979

(22) Filed: Sep. 6, 2012

(65) Prior Publication Data

US 2013/0057243 A1 Mar. 7, 2013

(30) Foreign Application Priority Data

Sep. 7, 2011 (TW) ..... 100132160 A

(51) Int. Cl.
*G05F 1/00* (2006.01)
*G05F 5/00* (2006.01)

(52) U.S. Cl.
CPC ..... *G05F 5/00* (2013.01)
USPC ..... 323/284

(58) Field of Classification Search
USPC ..... 323/282, 283, 284, 285
See application file for complete search history.

(56) References Cited

U.S. PATENT DOCUMENTS

| | | | | |
|---|---|---|---|---|
| 5,627,460 | A * | 5/1997 | Bazinet et al. | 323/288 |
| 7,372,241 | B1 * | 5/2008 | Tomiyoshi | 323/288 |
| 7,557,554 | B2 * | 7/2009 | Chang | 323/284 |
| 2007/0075695 | A1 * | 4/2007 | Gan et al. | 323/282 |
| 2008/0252274 | A1 * | 10/2008 | Schindler | 323/282 |
| 2008/0278128 | A1 * | 11/2008 | Nagase | 323/282 |
| 2010/0013452 | A1 * | 1/2010 | Tang et al. | 323/282 |
| 2011/0148377 | A1 * | 6/2011 | Schiff et al. | 323/283 |

* cited by examiner

*Primary Examiner* — Gary L Laxton
*Assistant Examiner* — Alex Torres-Rivera
(74) *Attorney, Agent, or Firm* — Winston Hsu; Scott Margo

(57) ABSTRACT

A power controller has a high-side driver, a low-side driver, a voltage divider, and a comparator. The high-side driver drives a high-side power switch, powered by a boost power line and a connection node. The low-side driver drives a low-side power switch, powered by an operation power line and a ground power line. The voltage divider has a first resistor having a first node for providing a detection voltage and a second node coupled to the boost power line or the connection node. The voltage divider has a second resistor coupled between the first node of the first resistor and the ground power line. When the low-side power switch is turned off, the comparator compares the detection voltage with a reference voltage. When the detection voltage is higher than the reference voltage, the comparator renders to turn on the high-side power switch.

10 Claims, 5 Drawing Sheets

POWER CONTROLLER AND CONTROL METHOD FOR GENERATING ADAPTIVE DEAD-TIMES

BACKGROUND OF THE INVENTION

1. Field of the Invention

The present invention is related to a switching power supply, more particularly to an adaptive dead time power supply.

2. Description of the Prior Art

A power supply powers electronic equipment. Practicability, efficiency, and size are usually the most concerned features. In numerous power supply topologies, LLC (inductor-inductor-capacitor) is one of the topologies able to implement zero-voltage switching to reduce switching loss. Comparing to other topologies, LLC is also able to output a current to a load twice in one switch cycle and thus improving output voltage regulation. LLC topology also has less EMI problem for the energy contained in the harmonic frequency of input current is quite small. Therefore, LLC topology is very popular in the market nowadays.

FIG. 1 is a diagram illustrating a prior art of LLC topology and LLC controller 30. A bridge rectifier 12 is coupled to two nodes of AC mains for providing a voltage $V_{IN}$ of 100V to 260V on a high power line IN. A high-side power switch 14 is coupled between the high power line IN and a connection node VS, and a low-side power switch 16 is coupled between the connection node VS and a ground power line. Two inductors 18, 20 and a capacitor 22 are coupled in series and between the connection node VS and the ground power line constituting an LC resonant circuit. In every LC resonant period, power is induced to inductors 24, 26 to power a load 28 alternatively.

The LLC controller 30 controls the high-side power switch 14 and the low-side power switch 16. A self boost circuit comprises a diode 32 and a self boost capacitor 34 so as to maintain a voltage $V_B$ of a boost power line VB to substantially at a voltage higher than a voltage $V_S$ of the connection node VS by $V_{DD}$. The voltage $V_{DD}$ is a voltage of an operation power line VDD. A high-side driver 36 generates a voltage signal $V_{HSG}$ to drive the high-side power switch 14; a low-side driver 38 generates a voltage signal $V_{LSG}$ to drive the low-side power switch 16. An oscillation controller 40 controls the timing sequence of the high-side power switch 14 and the low-side power switch 16. Because the voltage $V_S$ may be as high as 100V, the oscillation controller 40 controls the high-side driver 36 through a level shifter 42.

FIG. 2 is a timing diagram illustrating voltage signals of $V_S$, $V_{HSG}$, and $V_{LSG}$ from top to bottom. During a pull high section $T_H$, the voltage signal $V_{HSG}$ is logic 1; the voltage signal $V_{LSG}$ is logic 0; the high-side power switch 14 is short circuited and the low-side power switch 16 is open circuited; the voltage $V_s$ is substantially equal to the voltage of $V_{IN}$. During a pull low section $T_L$, the high-side power switch 14 is open circuited and the low-side power switch 16 is short circuited, the voltage $V_s$ is substantially equal to the voltage of 0V of the ground power line. A dead time section $T_{FD}$ is located in a time slot after the pull high section $T_H$ and before the pull low section $T_L$. A dead time section $T_{RD}$ is located in a time slot after the pull low section $T_L$ and before the pull high section $T_H$. In order to implement lossless switching of zero-voltage switch, the dead time $T_{FD}$ and the dead time $T_{RD}$ must be controlled properly.

In FIG. 1, the LLC controller 30 comprises a slope detector 41. A capacitor 44 is used to detect the voltage $V_s$ and to provide corresponding signal to the oscillation controller 40 so as to determine time lengths of the dead time $T_{FD}$ and the dead time $T_{RD}$.

SUMMARY OF THE INVENTION

A preferred embodiment of the present invention discloses a dead time control method related to a power supply. The power supply comprises a high-side power switch coupled to a high power line and a connection node, and a low-side power switch coupled to the connection node and a ground power line. The control method comprises driving the high-side power switch by a high-side driver, providing a voltage divider, and switching off the low-side power switch for raising a voltage of the connection node. The high-side driver is coupled between a boost power line and the connection node. A voltage difference between the boost power line and the connection node is maintained at a substantially predetermined value. The voltage divider comprises a first resistor and a second resistor. The first resistor has a first node for providing a first detection voltage and a second node coupled to the boost power line or the connection node. The second resistor is coupled between the ground power line and the first node of the first resistor. The control method further comprises comparing the first detection voltage and a first reference voltage when the voltage of the connection node is rising, and switching on the high-side power switch when the first detection voltage is higher than the first reference voltage.

A preferred embodiment of the present invention discloses an adaptive dead time controller. The controller comprises a high-side driver, a low-side driver, a voltage divider, and a first comparator. The high-side driver is powered by a boost power line and a connection node for driving a high-side power switch. The low-side driver is powered by an operation power line and a ground power line for driving a low-side power switch. The voltage divider comprises a first resistor and a second resistor. The first resistor has a first node for providing a detection voltage and a second node coupled to the boost power line or the connection node. The second resistor is coupled to the ground power line and the first node of the first resistor. The first comparator compares the detection voltage and a first reference voltage. The first comparator triggers the high-side driver to switch on the high-side power switch when the detection voltage is higher than the first reference voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
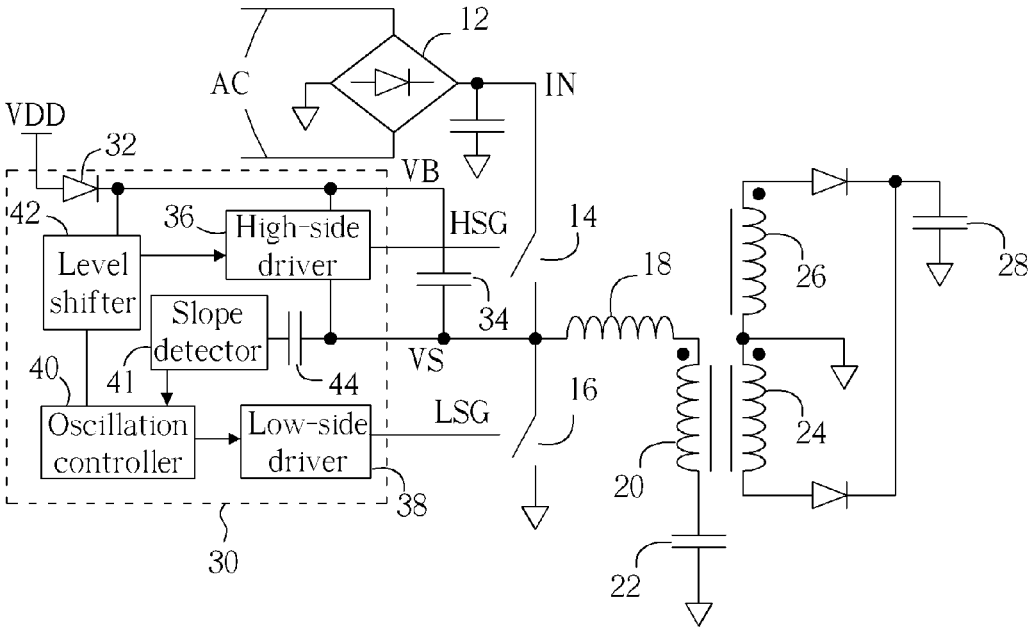
FIG. 1 PRIOR ART
FIG. 1 is a block diagram illustrating a prior art LLC topology and LLC controller.
Figure 2:
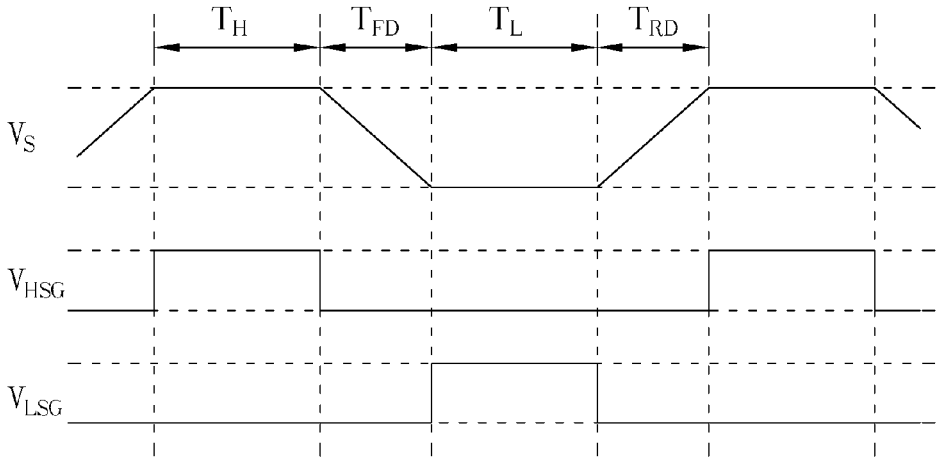
FIG. 2 PRIOR ART
FIG. 2 is a timing diagram illustrating signals of FIG. 1.
Figure 3:
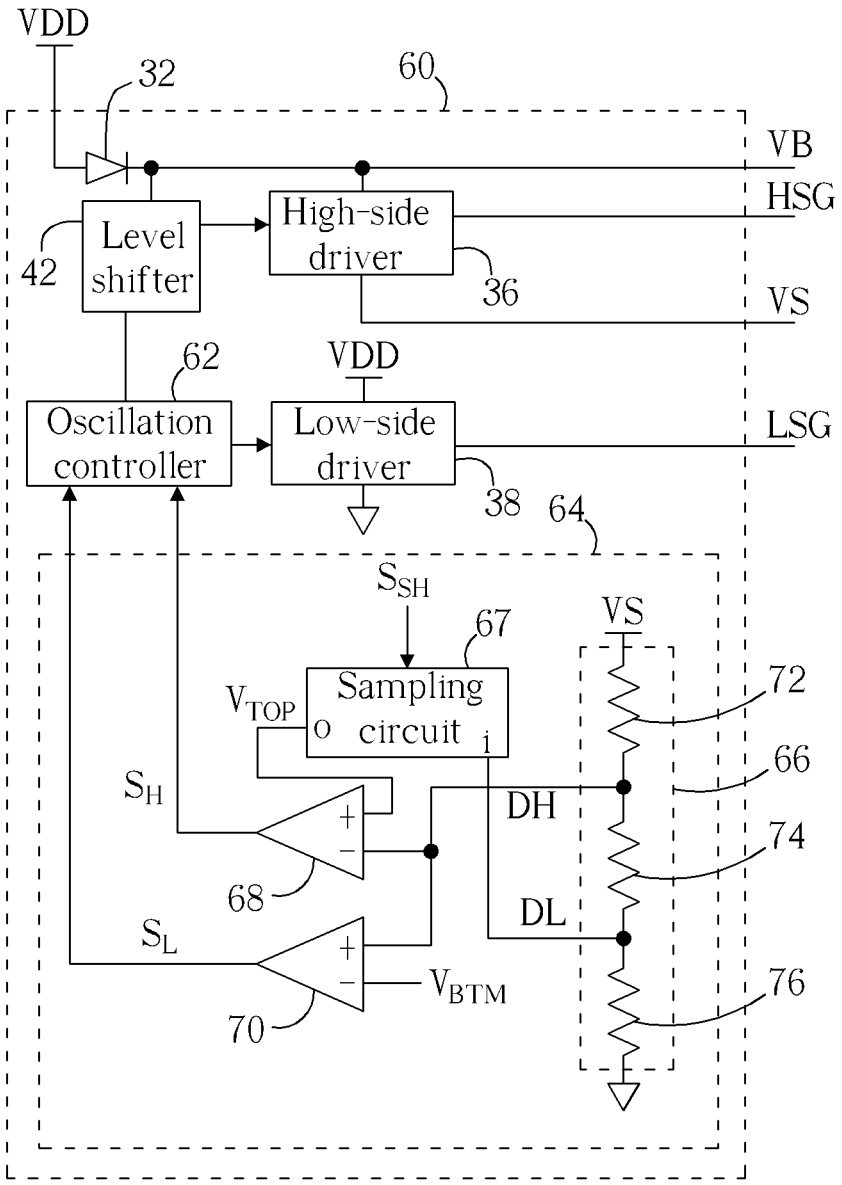
FIG. 3 is a block diagram illustrating an LLC controller of the present invention.

Please refer to FIG. 3 illustrating an LLC controller 60 of one embodiment of the present invention. The LLC controller 60 comprises a high-side driver 36, a low-side driver 38, a level shifter 42, an oscillation controller 62, and a dead time controller 64. The LLC controller 30 of FIG. 1 can be replaced with the LLC controller 60 to control an LLC topology. Components with the same reference numerals in FIG. 3 and FIG. 1 have the same or similar functions and are well known to those with ordinary skill in the art.

The dead time controller 64 comprises a voltage divider 66, a sampling circuit 67, and comparators 68 and 70. The voltage divider 66 comprises a first resistor 72, a second resistor 74, and a third resistor 76 coupled in series between a connection node VS and a ground power line. The first resistor 72 has a first node DH for providing a detection voltage $V_{DH}$ and a second node coupled to the connection node VS, the second resistor 74 has a first node coupled to the first node of the first resistor 72 and a second node DL coupled to the third resistor 76 for providing a detection voltage $V_{DL}$. It can be known from circuit structure, a voltage $V_S$ at the connection node VS is higher than the detection voltage $V_{DH}$, and the detection voltage $V_{DH}$ is higher than the detection voltage $V_{DL}$. The proportion of the voltage $V_S$ to the detection voltage $V_{DH}$ and to the detection voltage $V_{DL}$ is substantially fixed.

Figure 4:
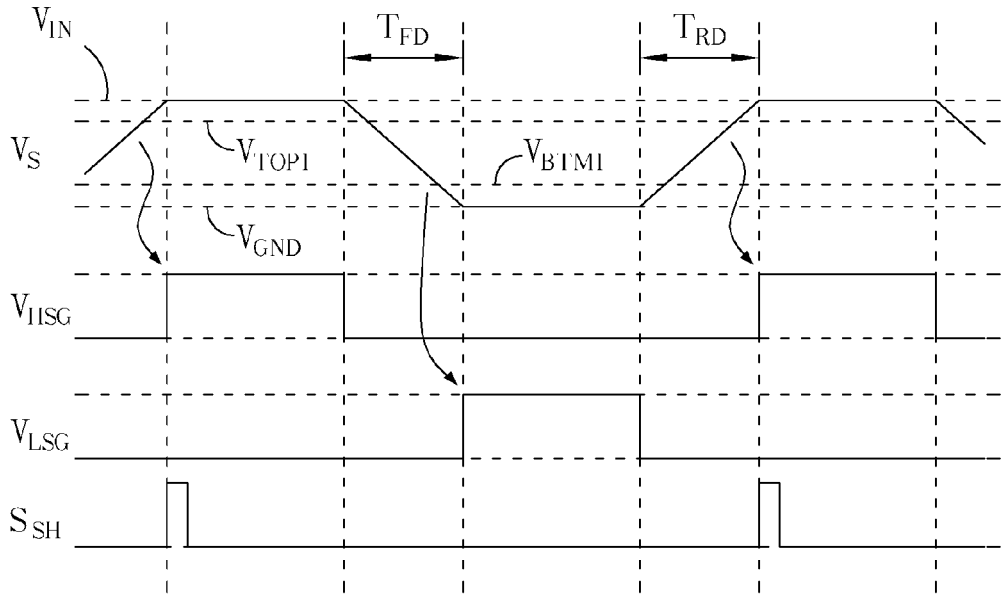
FIG. 4 is a timing diagram illustrating signals of FIG. 3.

Please refer to FIG. 3 and FIG. 4 together. FIG. 4 is a timing diagram illustrating the voltage signal $V_S$, a voltage signal $V_{HSG}$, a voltage signal $V_{LSG}$, and a sampling signal $S_{SH}$ of the LLC controller 60 of FIG. 3 adapted to the LLC topology of FIG. 1.

The sampling circuit 67 samples the sampling signal $S_{SH}$ of the detection voltage $V_{DL}$ at the second node of the second resistor DL when the high-side driver 36 switches on a high-side power switch 14 so as to update a reference voltage $V_{TOP}$. As illustrated in FIG. 4, when the high-side power switch 14 is switched on, the voltage $V_S$ of the connection node VS is almost equal to a voltage $V_{IN}$ of a high power line IN, therefore the reference voltage $V_{TOP}$ is actually corresponding to the voltage $V_{IN}$.

As soon as the low-side driver 38 switches off a low-side power switch 16, condition $T_{RD}$ is met. Meanwhile, an inductor in a resonant circuit charges the connection node VS and raises the voltage $V_S$, detection voltages $V_{DH}$, and $V_{DL}$. If the detection voltage $V_{DH}$ is higher than the reference voltage $V_{TOP}$ which means the voltage $V_S$ of the connection node VS is higher than a reference voltage $V_{TOP1}$ related to the reference voltage $V_{TOP}$, the voltage $V_S$ is almost equal to the voltage $V_{IN}$ and is time to perform zero voltage switching. The comparator 68 provides a trigger signal $S_H$ to signal the high-side driver 36 to switch on the high-side power switch 14 through the oscillation controller 62 and the level shifter 42. For example, proportion of values of resistors 76 and 74 can be set to substantially at 9:1. So the reference voltage $V_{TOP1}$ is about 90% of the voltage $V_{IN}$.

Similarly, as soon as the high-side driver 36 switches of the high-side power switch 14, condition $T_{FD}$ is met. Meanwhile, the inductor in the resonant circuit discharges the connection node VS and dropping the voltage $V_S$, the detection voltage $V_{DH}$, and $V_{DL}$. If the detection voltage $V_{DH}$ is lower than a reference voltage $V_{BTM}$, which means the voltage $V_S$ of the connection node VS is lower than a reference voltage $V_{BTM1}$ related to the reference voltage $V_{BTM}$ and is time to perform zero voltage switching. The comparator 70 provides a trigger signal $S_L$ to signal the low-side driver 38 to switch on the low-side power switch 16 through the oscillation controller 62. In a preferred embodiment, the reference voltage $V_{BTM1}$ is approximately 0V, such as 0.5V.

As illustrated above, the dead time controller 64 is able to switch on the high-side power switch 14 when the voltage $V_S$ is close to the voltage $V_{IN}$ or switch on the low-side power switch 16 when the voltage $V_S$ is close to 0V. Thus, the dead time controller 64 can automatically adjust the dead time $T_{FD}$ and $T_{RD}$ properly under different load condition to reach zero voltage switching.

In a preferred embodiment, the oscillation controller 62 provides a minimum dead time control to ensure the dead time $T_{FD}$ and $T_{RD}$ to be not shorter than a predetermined value.

Figure 5:
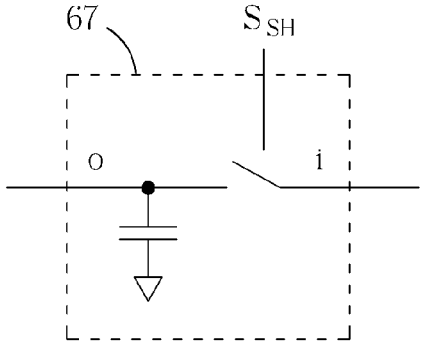
FIG. 5 is a block diagram illustrating a sampling circuit of FIG. 3.

FIG. 5 is a block diagram illustrating the sampling circuit of FIG. 4. Circuit operation is known to those skilled in the art.

Figure 6:
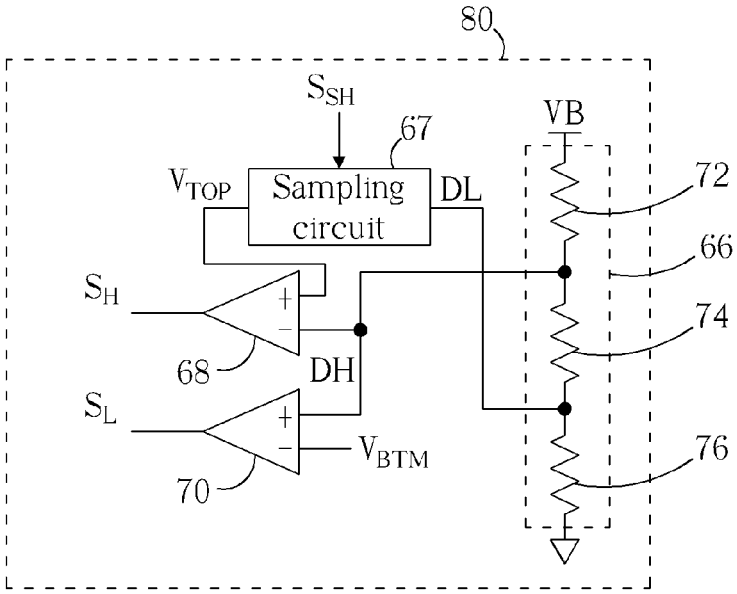
FIG. 6 is a block diagram illustrating another dead time controller of the present invention.
Figure 7:
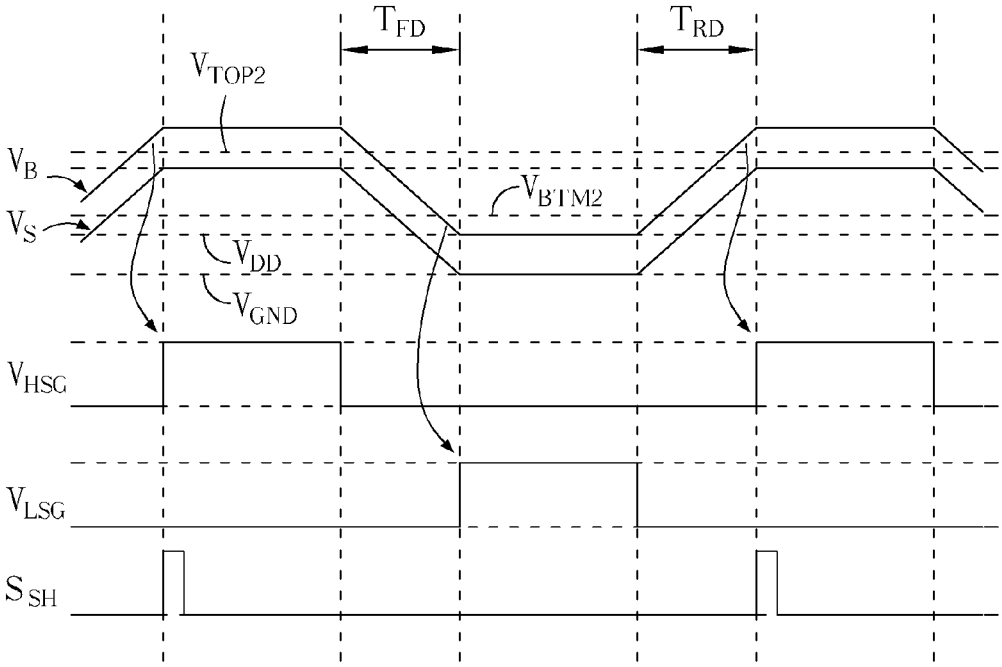
FIG. 7 is a timing diagram illustrating signals of FIG. 6.

FIG. 6 is a block diagram illustrating another dead time controller 80 of the present invention. The dead time controller 64 of FIG. 3 can be replaced with the dead time controller 80. FIG. 7 is a timing diagram illustrating a voltage signal $V_B$, the voltage signal $V_S$, the voltage signal $V_{HSG}$, the voltage signal $V_{LSG}$ and the sampling signal $S_{SH}$ so as to explain the operation of controller of FIG. 6.

The difference between the dead time controller 80 and the dead time controller 64 of FIG. 3 is that the voltage divider 66 is coupled between a boost power line $V_B$ and the ground power line. Therefore in the embodiment, the detection voltage $V_{DH}$ and $V_{DL}$ of the first node DH of the first resistor 72 and the second node DL of the second resistor 74 are substantially related to the voltage $V_B$ of the boost power line VB. Though the comparator 68 compares the reference voltage $V_{TOP}$ and the detection voltage $V_{DH}$, it serves the same purpose as comparing the voltage $V_B$ and a reference voltage $V_{TOP2}$ of FIG. 7. The comparator 68 triggers the high-side driver 36 to switch on the high-side power switch 14 when the voltage $V_B$ is higher than the reference voltage $V_{TOP2}$. Similarly, the comparator 70 triggers the low-side driver 38 to switch on the low-side power switch 16 when the voltage $V_B$ is lower than the reference $V_{BTM2}$ of FIG. 7. In so doing, zero voltage switching can also be reached.

Figure 8:
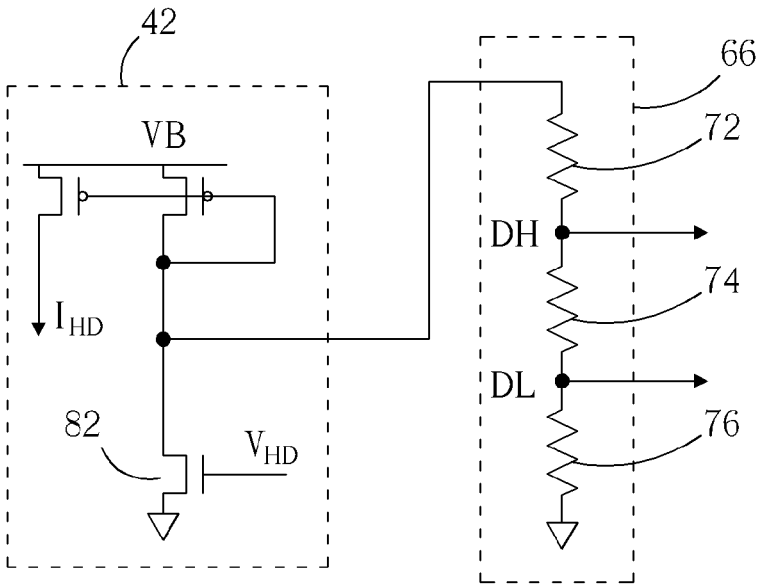
FIG. 8 is a block diagram illustrating a voltage divider and a level shifter of an embodiment of the present invention.

In previous embodiment, a high voltage node of the voltage divider 66 is either coupled to the boost power line VB or the connection node VS, and these two nodes are both a power source to the high-side driver 36. Any embodiment with the high voltage node of the voltage divider 66 coupled to a voltage corresponding to the voltage $V_B$ or the voltage $V_S$ is related to the present invention. FIG. 8 is a block diagram illustrating one embodiment of the divider 66 and the level shifter 42. The level shifter 42 transforms a low voltage signal $V_{HD}$ into a current signal $I_{HD}$ flowing to the high-side driver 36 by a current mirror constituting an NMOS transistor 82 and PMOS transistors. The high voltage node of the voltage divider 66 is coupled to a drain of the NMOS transistor 82. It can be known from circuit structure that a drain voltage of the NMOS transistor 82 varies with the voltage $V_B$ to substantially at $V_B$-$V_{THP}$. The voltage $V_{THP}$ is a threshold voltage of the PMOS transistor.

In FIG. 8, the NMOS transistor 82 must be a high voltage component to withstand a voltage above 200 volts, thus the drain occupies a large silicon area when implementing on an integrated circuit. The first, second and third resistors 72, 74, 76 of the voltage divider 66 can be implemented on the silicon area for which the drain (the high voltage node) of the NMOS transistor 82 occupies by using high-resistant poly-silicon. In so doing, the first, second and third resistor 72, 74, 76 share substantially the same silicon area with the NMOS transistor 82 to save cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for controlling a dead time of a power supply, the power supply comprising a high-side power switch coupled between a high power line and a connection node, and a low-side power switch coupled between the connection node and a ground power line, the method comprising:

driving the high-side power switch by a high-side driver, the high-side driver being coupled between a boost power line and the connection node, a voltage difference between the boost power line and the connection node being maintained at a substantially predetermined value;

providing a voltage divider comprising a first resistor, a second resistor and a third resistor, the first resistor having a first node for providing a first detection voltage and a second node coupled to the boost power line or the connection node, the second resistor being coupled between the ground power line and the first node of the first resistor, the third resistor being coupled between the second resistor and the ground power line to provide a second detection voltage;

switching off the low-side power switch for raising a voltage of the connection node;

sampling the second detection voltage;

generating the first reference voltage based on the sampling the second detection voltage;

comparing the first detection voltage and the first reference voltage when the voltage of the connection node is rising; and switching on the high-side power switch when the first detection voltage is higher than the first reference voltage.

2. The method of claim 1 further comprising:

switching off the high-side power switch for dropping the voltage of the connection node;

comparing the first detection voltage and a second reference voltage; and switching on the low-side power switch when the first detection voltage is lower than the second reference voltage.

3. The method of claim 1 further comprising:

updating the first reference voltage when the high-side power switch is switched on.

4. The method of claim 1 further comprising:

providing the second detection voltage with a voltage lower than the first detection voltage; and updating the first reference voltage by the second detection voltage when the high-side power switch is switched on.

5. An adaptive dead time controller comprising:

a high-side driver powered by a boost power line and a connection node, the high-side driver drives a high-side power switch;

a low-side driver powered by an operation power line and a ground power line, the low-side driver drives a low-side power switch;

a voltage divider comprising a first resistor, a second resistor and a third resistor, the first resistor having a first node for providing a first detection voltage and a second node coupled to the boost power line or the connection node, the second resistor being coupled between the ground power line and the first node of the first resistor, the third resistor being coupled between the second resistor and the ground power line to provide a second detection voltage; and a sampling circuit, wherein the sampling circuit generates the first reference voltage based on sampling the second detection voltage; and a first comparator comparing the first detection voltage and the first reference voltage when the low-side power switch is switched off;

wherein the first comparator triggers the high-side driver to switch on the high-side power switch when the first detection voltage is higher than the first reference voltage.

6. The controller of claim 5 further comprising:

a second comparator comparing the first detection voltage and a second reference voltage;

wherein the second comparator triggers the low-side driver to switch on the low-side power switch when the first detection voltage is lower than the second reference voltage.

7. The controller of claim 5 further comprising:

the sampling circuit updates the first reference voltage by the second detection voltage when the high-side power switch is switched on.

8. The controller of claim 5, further comprising:

a level shifter coupled to the high-side driver, the level shifter comprising a high voltage component having a high voltage node for withstanding a voltage above 200 volt;

wherein the first resistor is coupled to the high voltage node.

9. The method of claim 1 further comprising:

sampling the first reference voltage when the high-side power switch is turned on.

10. The controller of claim 5 wherein the sampling circuit samples the first reference voltage when the high-side power switch is turned on.

* * * * *